US009915495B2

(12) United States Patent
Higgins et al.

(10) Patent No.: US 9,915,495 B2
(45) **Date of Patent: *Mar. 13, 2018**

(54) PAINTBALL MARKER AND LOADER SYSTEM

(71) Applicant: HTR Development, LLC, Orlando, FL (US)

(72) Inventors: John Higgins, Indianapolis, IN (US); Benjamin Lynn Frederick, Gotha, FL (US)

(73) Assignee: HTR Development, LLC, Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/435,568

(22) Filed: Feb. 17, 2017

(65) Prior Publication Data

US 2017/0160045 A1 Jun. 8, 2017

Related U.S. Application Data

(63) Continuation of application No. 15/019,391, filed on Feb. 9, 2016, now Pat. No. 9,823,039, which is a continuation of application No. 14/827,754, filed on Aug. 17, 2015, now Pat. No. 9,255,766, which is a continuation of application No. 13/422,582, filed on Mar. 16, 2012, now Pat. No. 9,109,853, which is a continuation-in-part of application No. 12/187,854, filed on Aug. 7, 2008, now Pat. No. 8,312,870.

(Continued)

(51) Int. Cl.

| | |
|---|---|
| ***F41B 11/57*** | (2013.01) |
| ***F41B 11/53*** | (2013.01) |
| ***F41B 11/71*** | (2013.01) |

(52) U.S. Cl.

CPC ..... *F41B 11/57* (2013.01); *F41B 11/53* (2013.01); *F41B 11/71* (2013.01)

(58) Field of Classification Search

CPC ..... F41B 11/53; F41B 11/57; F41B 11/70; F41B 11/71; F41A 19/58; F41A 19/69

USPC ..... 124/32, 49, 51.1, 71, 72; 221/258

See application file for complete search history.

(56) References Cited

U.S. PATENT DOCUMENTS

| | | | |
|---|---|---|---|
| 3,063,184 | A | 11/1962 | Sukala |
| 3,634,964 | A | 1/1972 | Nail |

(Continued)

*Primary Examiner* — Alexander Niconovich

(74) *Attorney, Agent, or Firm* — Woodard, Emhardt, Moriarty, McNett & Henry LLP

(57) ABSTRACT

Among other things, methods and apparatus regarding collection, dissemination and display of information concerning paintball loaders and markers are disclosed. A loader includes a heads-up display, electronic devices for gathering, storing and disseminating information, and an antenna for sending and receiving data. Wireless voice communications among paintball players is possible via associated headsets. There is also disclosed paintball equipment and methods for controlling both the firing and loading mechanism of paintball equipment. Current systems or mechanisms have individual and discrete electronic control systems for firing operations, e.g. located in the paintball gun itself, and loading operations, e.g. located inside the paintball loader. The present disclosure unifies the electronic control of said firing and loader operations into a single electronic circuit board located on either the paintball gun or paintball loader.

16 Claims, 5 Drawing Sheets

Related U.S. Application Data

(60) Provisional application No. 60/954,724, filed on Aug. 8, 2007.

(56) References Cited

U.S. PATENT DOCUMENTS 3,787,993 A 1/1974 Lyon
4,181,911 A 1/1980 Black
4,636,271 A 1/1987 Gandolfo
4,699,116 A 10/1987 Freeland et al.
4,716,809 A 1/1988 A'Costa
RE32,752 E 9/1988 Kiang
4,922,642 A 5/1990 Ohlhauser
5,046,276 A 9/1991 Morris
5,099,519 A 3/1992 Guan
5,282,454 A 2/1994 Bell et al.
5,359,576 A 10/1994 Bunner et al.
5,427,380 A 6/1995 Hazard et al.
5,605,505 A 2/1997 Han
5,736,720 A * 4/1998 Bell ..... F41B 11/57 235/1 B
5,752,630 A 5/1998 Guo
5,791,325 A 8/1998 Anderson
5,794,606 A 8/1998 Deak
5,816,232 A 10/1998 Bell
5,850,706 A 12/1998 Evans
5,867,817 A 2/1999 Catallo et al.
5,890,308 A 4/1999 Harrington
5,947,100 A 9/1999 Anderson
6,003,504 A 12/1999 Rice et al.
6,062,208 A * 5/2000 Seefeldt ..... F41B 11/00 124/71
6,129,959 A 10/2000 Mercer et al.
6,142,137 A 11/2000 MacLaughlin
6,213,110 B1 4/2001 Christopher et al.
6,244,260 B1 6/2001 Ragoza et al.
6,289,616 B1 9/2001 Alvern
6,305,367 B1 * 10/2001 Kotsiopoulos ..... F41B 11/57 124/49
6,311,682 B1 11/2001 Rice et al.
6,415,781 B1 7/2002 Perrone
6,418,919 B1 7/2002 Perrone
6,467,473 B1 10/2002 Kotsiopoulos
6,481,432 B2 * 11/2002 Rushton ..... F41B 11/57 124/49
6,488,019 B2 12/2002 Kotsiopoulos
6,502,567 B1 1/2003 Christopher
6,539,931 B2 4/2003 Trajkovic et al.
6,545,587 B1 4/2003 Hatakeyama et al.
6,590,386 B1 * 7/2003 Williams ..... F41A 19/01 124/71
6,609,511 B2 8/2003 Kotsiopoulos
6,615,814 B1 * 9/2003 Rice ..... F41A 17/06 124/71
6,644,293 B2 11/2003 Jong
6,666,746 B2 12/2003 Aldred et al.
6,722,073 B2 4/2004 Cossio
6,748,938 B2 * 6/2004 Rice ..... F41A 17/06 124/56
6,779,518 B2 * 8/2004 Dobbins ..... F41A 9/62 124/71
6,860,259 B2 3/2005 Rice et al.
6,885,332 B2 4/2005 Panek et al.
6,889,680 B2 * 5/2005 Christopher ..... F41B 11/57 124/48
6,915,792 B1 7/2005 Sheng
6,928,999 B1 8/2005 Hslao
6,941,693 B2 9/2005 Rice et al.
6,986,221 B2 1/2006 Mullis
7,017,569 B2 3/2006 Jong
7,100,437 B2 * 9/2006 Johnson ..... F41A 19/01 73/167
7,143,644 B2 12/2006 Johnson et al.
7,229,105 B2 6/2007 Broersma
7,270,121 B2 9/2007 Lubben
7,278,417 B2 10/2007 Ciesiun
7,458,370 B2 12/2008 Chen
7,594,502 B1 * 9/2009 Anderson ..... F41B 11/54 124/71
7,654,255 B2 * 2/2010 Spicer ..... F41B 11/57 124/49
7,673,627 B2 3/2010 Higgins et al.
7,694,669 B2 * 4/2010 Campo ..... F41B 11/53 124/51.1
7,818,910 B2 * 10/2010 Young ..... F41C 23/16 42/106
7,832,389 B2 11/2010 Christopher
7,841,328 B2 11/2010 Italia et al.
7,900,622 B2 3/2011 Douglas et al.
8,100,119 B2 1/2012 Hall
8,118,016 B2 2/2012 Italia et al.
8,210,159 B1 7/2012 Neumaster et al.
8,235,031 B2 8/2012 Kim
8,312,871 B1 * 11/2012 Kulp ..... F41B 11/53 124/51.1
8,360,042 B2 1/2013 Skilling
8,402,959 B1 3/2013 Nungester
8,448,631 B2 5/2013 Spicer et al.
8,459,245 B1 6/2013 Fiorill et al.
8,863,733 B2 10/2014 Skilling
2002/0020402 A1 2/2002 Kotsiopoulos
2002/0117159 A1 8/2002 Kotsiopoulos et al.
2002/0148455 A1 10/2002 Trajkovic et al.
2003/0010330 A1 1/2003 Jong
2003/0131836 A1 7/2003 Dobbins
2004/0055588 A1 3/2004 Rice et al.
2004/0134475 A1 7/2004 Jong
2004/0198336 A1 * 10/2004 Jancic ..... F41G 1/35 455/420
2005/0178374 A1 8/2005 Tseng
2005/0185512 A1 8/2005 DeHaan et al.
2005/0188975 A1 9/2005 Rice et al.
2005/0274371 A1 12/2005 Lubben
2006/0130822 A1 6/2006 Jong
2007/0012304 A1 1/2007 van Dorsser et al.
2007/0175463 A1 8/2007 Higgins et al.
2007/0256676 A1 11/2007 Orvis et al.
2008/0010890 A1 1/2008 Vice et al.
2008/0047536 A1 * 2/2008 Chen ..... F41B 11/57 124/51.1
2008/0115660 A1 5/2008 Hensel
2008/0236558 A1 10/2008 Bosch et al.
2009/0101128 A1 * 4/2009 Lian ..... F41B 11/57 124/71
2009/0159059 A1 * 6/2009 Newman ..... F41A 33/04 124/32
2009/0159064 A1 * 6/2009 Newman ..... F41A 19/01 124/71
2009/0241929 A1 * 10/2009 Italia ..... F41B 11/57 124/51.1
2010/0126485 A1 * 5/2010 Neumaster ..... F41B 11/57 124/51.1
2010/0154766 A1 6/2010 Skilling
2010/0154786 A1 6/2010 Li
2010/0258101 A1 * 10/2010 Campo ..... F41B 11/57 124/51.1
2011/0067681 A1 3/2011 Stevens et al.
2013/0039655 A1 2/2013 Monks et al.
2014/0034036 A1 2/2014 Skilling

* cited by examiner

PAINTBALL MARKER AND LOADER SYSTEM

This application is a continuation of U.S. patent application Ser. No. 15/019,391, filed Feb. 9, 2016 which is a continuation of Ser. No. 14/827,754, filed Aug. 17, 2015 which is a continuation of Ser. No. 13/422,582, filed on Mar. 16, 2012 which is a continuation-in-part of U.S. patent application Ser. No. 12/187,854, filed on Aug. 7, 2008, which claims the benefit of U.S. Provisional Patent Application Ser. No. 60/954,724, filed on Aug. 8, 2007, the entire disclosures of which are incorporated herein by reference.

BACKGROUND

The sport of paintball generally involves individuals or teams armed with pneumatic launchers ("guns" or "markers") that shoot pellets filled with paint ("paintballs"). The objectives of different games may vary, but a common feature is that the teams or individuals shoot the pellets at each other or other targets, and measure a score based on hits made on the targets.

The sport has become quite competitive over the years, and accordingly a variety of improvements to a basic pneumatic gun have been made. In recent years, paintball markers have been equipped with electrical or electronic components so as to allow faster firing, to make actuating the trigger easier, and to provide information or control concerning the operation of the marker. For example, rather than a mechanical linkage between a trigger and a pressurized-gas source, markers are known that have hard-wired electronic contacts associated with the trigger, with a circuit connected through the gas source, so that pulling a trigger sends a signal to a valve that briefly opens to allow pressurized gas to propel a paint pellet. Similarly, counters or other sensors attached to various parts of the gun can be used to gather data about the use or performance of the gun.

There are also loader devices that are used with paintball markers and act as a reservoir for paintballs, feeding them into the marker for firing. Such devices have also been equipped with electric or electronic parts, particularly to maintain steady feeding of paintballs and to count or monitor the usage of the paintballs.

Existing paintball equipment maintains the most sophisticated and important circuitry in the marker. This is generally because the marker is considered the most important part of such a system, and because its firing and other operational characteristics are generally considered the vital features to monitor and change. Currently, however, a user trades or replaces his or her marker relatively frequently. High-end marker frames are also carefully manufactured by milling and other processes to ensure an excellent grip and balance. Repairs or changes to features of a marker are thus difficult, and can result in damage to an expensive marker. An existing device places a screen and buttons for changing the characteristics of a paintball marker in the marker's handle (see U.S. Pat. No. 6,311,682). While an advance over devices that came before it, that configuration is hard to use effectively because the user must move his or her hand from the handle in order to view the screen and press the buttons. A more user-friendly device and methods for monitoring and communicating parameters for paintball equipment and events is needed.

Most performance guns and loaders currently available contain an electronic circuit board in both the loader and the gun. The circuit board in the gun (the "gun board") operates largely independently from the circuit board in the loader (the "loader board"). For example, the gun board is powered by a battery in the paintball gun, while the loader board is powered by a separate battery in the loader. Similarly, the gun board monitors various switches and sensors (e.g. those in the gun) independently of those monitored by the loader board (e.g. those in the loader).

Some paintball systems attempt to bridge the informational gap between the gun board and loader board by installing wireless devices on each (see, e.g., U.S. Pat. No. 7,673,627 to Higgins et al.). By using wireless communication between the gun board and loader board, these embodiments significantly reduce the time which the loader board sits idle before acknowledging that the gun board it is attached to has fired a paintball, and thus noting the need for the loader to load additional paintballs into the marker. Wireless communication between the gun and loader synchronizes the two electronic systems, resulting in faster paintball feeding, faster rates of fire, fewer malfunctions, and generally better performance.

While the wireless systems are an improvement from their predecessor, the introduction of wireless technologies into paintball equipment has created a number of technical and manufacturing obstacles. First, manufacturers must install wireless transceivers in or on both the gun boards and loader boards so the two circuit boards can communicate. Such transceivers are typically expensive, and sometimes requires that a number of additional components be included to support the wireless operations (an antenna, as one example). Second, technical difficulties can arise when a plurality of wireless-enabled guns and loaders enter the same space. Communication from or between one gun and loader combination may unintentionally interfere with the communications of another unit. Paintball manufacturers are known to utilize separate wireless channels or assign unique wireless keys to each gun and loader combination to prevent unintended interference, though this work-around introduces additional complexity and cost. Finally, intentional wireless emitters or radiators as described herein are required to comply with extensive, and often expensive, regulatory requirements. Moreover, every iteration of the design must be re-certified in every jurisdiction; essentially this requires certification of the same basic design every time the physical shape of the circuit board is modified to fit in a different loader or gun.

While the wireless paintball units perform better than their predecessors, the cost of implementing the improvements may deter adoption by some consumers. A cost-efficient solution is proposed.

SUMMARY

Among other things, there is disclosed an apparatus including a paintball loader adapted to operate with a paintball marker to provide a supply of paintballs to the marker, the loader including a shell, an electronic display, a circuit board and an antenna. The shell, in a particular embodiment, defines a front portion, a rear portion, a chamber between the front and rear portions, and an outlet connected to the chamber, the chamber for holding a supply of paintballs so that the paintballs can exit the loader through the outlet. The electronic display is fixed to the rear portion of the shell and has a visible area facing outward from the shell. The circuit board is within the rear portion of the loader and is substantially parallel to the visible area of the display and between the chamber and the display, and it includes a microcontroller having electronic memory, a transceiver electronically connected to the microcontroller and a plurality of ports for input and/or output of electronic signals that are electronically connected to the microcontroller. The antenna is connected to the circuit board via an electrical conductor and is within the shell adjacent the chamber and opposite the outlet.

In certain embodiments, a wireless headset is communicatively connected to the microcontroller. The headset can include at least one speaker and at least one microphone, so that a voice message spoken into the microphone is received by the transceiver in the loader, and an external voice message received by the transceiver is transmitted to the headset's speaker. The loader can be physically connected to a paintball marker, the loader and marker having a wireless communication link established between them, so that information concerning the marker is passed to and stored in the microcontroller in the loader. The electronic memory of the microcontroller may include stored data concerning operation of the loader, and/or stored data of communications received by the loader.

The electronic display is an LCD or OLED in some embodiments, which may have at least one mode in which touch-screen input is activated. When the loader is physically connected to a paintball marker having a barrel, and the marker has a line of fire along the barrel, the display is substantially perpendicular to the line of fire and so the visible area faces the marker's user as he or she extends the marker along the line of fire.

Also disclosed are various methods. Among these are methods including providing a plurality of paintball loaders having circuitry including a microcontroller and associated paintball markers having circuitry, each of the loaders being physically connected to a respective one of the markers; establishing a wireless link between each of the microcontrollers and a separate computer, so that each of the microcontrollers are identified as a communication group and each of the microcontrollers is assigned an identification code over the wireless link; broadcasting a message from one of the loaders, which message includes information identifying the broadcasting loader or at least one loader in the communication group; receiving the message by at least one of the loaders, with the message being sent to the microcontroller of the receiving loader; and sending the message to a visual or auditory output associated with the receiving loader.

Methods may also include providing a plurality of headsets having at least one speaker and a microphone, each of the headsets being associated with a respective loader, where the broadcasting includes speaking the message into a microphone of a headset, and the message is transmitted from that headset to its associated loader. The speaker of such a headset can function as the auditory output for messages received by its associated loader. A wireless link can be established between a loader and its respective marker, and signal(s) concerning data of the marker can be transmitted from the marker to its associated loader, with the data displayed on a display on the loader. A message can be stored in the microcontroller of a loader for access following sending the message to an output. Methods can also include replying to the original message, as by broadcasting a second message from the loader involved in receiving the original message. The second message includes information identifying that receiving loader or at least one loader in the communication group, and it is received by at least one of the loaders and sent to the microcontroller of the loader receiving the second message.

In addition, the present disclosure describes a cost-efficient hard-wired electronic connection between the gun and loader. The hard-wired connection eliminates the need to install separate circuit boards in both the gun and loader. Moreover, the wired connection between the gun and loader enables a single battery to be used to power both the gun and loader.

The hard-wired connection running between the gun and loader may be embodied in a number of ways. In one particular embodiment, the feedneck on the gun and paintball chute on the loader both have exposed metal leads. When the loader is placed on the gun, an electronic connection is established between the gun and loader. Other methods of establishing a hard-wired connection between the gun and loader are similarly envisioned.

The elimination of a second circuit board reduces component and material costs; a similar cost reduction is realized by utilizing a single battery to power both the gun and loader. The elimination of these electronic components and the second battery further reduces the weight of the paintball equipment, which is a desirable for professional and amateur paintball participants alike.

As examples, a paintball system can include a marker for shooting paintballs. The marker has a barrel through which paintballs are propelled and a cavity communicating with the barrel for holding at least one paintball preparatory to firing it through the barrel, as well as an opening from outside of the marker that communicates with the cavity. The system also includes a loader for storing paintballs for eventual loading into the marker via its opening. The loader can have a storage chamber and a tube with an inner wall and an outer wall, the tube being adapted to fit within the marker's opening so that paintballs can travel through the tube or conduit and into the marker when the marker and loader are in an assembled state. The marker includes one or more electronic contacts, which in one embodiment are adjacent the opening of the marker. The loader includes one or more corresponding electronic contacts, which in one embodiment are adjacent the tube of the loader. When the marker and loader are in the assembled state, the marker electronic contacts and the loader electronic contacts engage each other so that one or more electronic signals can travel between the marker and loader.

In particular embodiments, at least one of the marker electronic contacts or at least one of loader electronic contacts (i.e. one or more contacts of either the marker or loader or of both) include an exposed metal lead. Such an exposed metal lead may rest on or be embedded in a surface, so that a portion of said metal lead is accessible in or along the surface. Such contacts may be spring-loaded, e.g. to ensure or enhance engagement. Such contacts may also be prongs and/or sockets, with similar and/or corresponding compatible contact(s). Thus, if a marker has a prong or socket contact, the loader will have a corresponding contact that is a prong or socket to be compatible with the marker contact. In other embodiments, hard-wired communication between the gun and loader may be provided, with the marker and loader either sharing or each having their respective power and computing sources. Such a hard-wired embodiment where the marker and loader have respective power and computing sources would not require transmission of electrical current between the gun and loader, and so fiber-optic or other non-wireless methods of communication with or without metal leads between the marker and loader could be used.

Such systems have each contacts (e.g. the marker contact) connected to one or more electronic components of its device (e.g. the marker), via a connector. Such connectors can be one or more of cable, wire, buses, printed circuitry, and the like. The loader electronic contact(s) and marker electronic contact(s) form one or more respective pairs of contacts that are connected in the assembled state, and such pair(s) of contacts when connected can form an electronic pathway(s) between a battery in one of the loader and marker and an electronic component in the other. In particular embodiments, the loader does not have a microcontroller, and is electronically connected via at least one of the loader contacts and one or more corresponding marker contacts to a microcontroller of the marker, so that the loader can rely on the microcontroller of the marker for at least part of the operation of the loader. As another example, a loader does not include a sufficient internal power source for operating its projectile-loading or -feeding function(s) (e.g. operation of en electric feeding mechanism), and in the assembled state at least one of the loader contacts and at least one corresponding marker contact provides a pathway for energy to be transferred from the marker to the loader for performing the loading function(s). Likewise, embodiments of a marker may not include a sufficient internal power source for operating its projectile-firing function(s), and in the assembled state at least one of the marker contacts and at least one corresponding loader contact provides a pathway for energy to be transferred from the loader to the marker for performing such firing function(s).

In the assembled state, the loader and marker can have an interference or snap fit, with such a fit forcing the respective contact pairs into engagement with each other. As one example, such a fit may exist between the loader tube and the opening in the marker, or between portions of the marker and loader outside of the opening and tube.

DETAILED DESCRIPTION OF THE ILLUSTRATED EMBODIMENTS

To promote an understanding of the principles of the disclosure, reference will now be made to certain embodiments and specific language will be used to describe the same. It will nevertheless be understood that no limitation of the scope of the claims is thereby intended, such alterations and further modifications of the disclosed methods and/or devices, and such further applications of the principles of the disclosure as described herein, being contemplated as would normally occur to one skilled in the art to which the disclosure relates.

Figure 1:
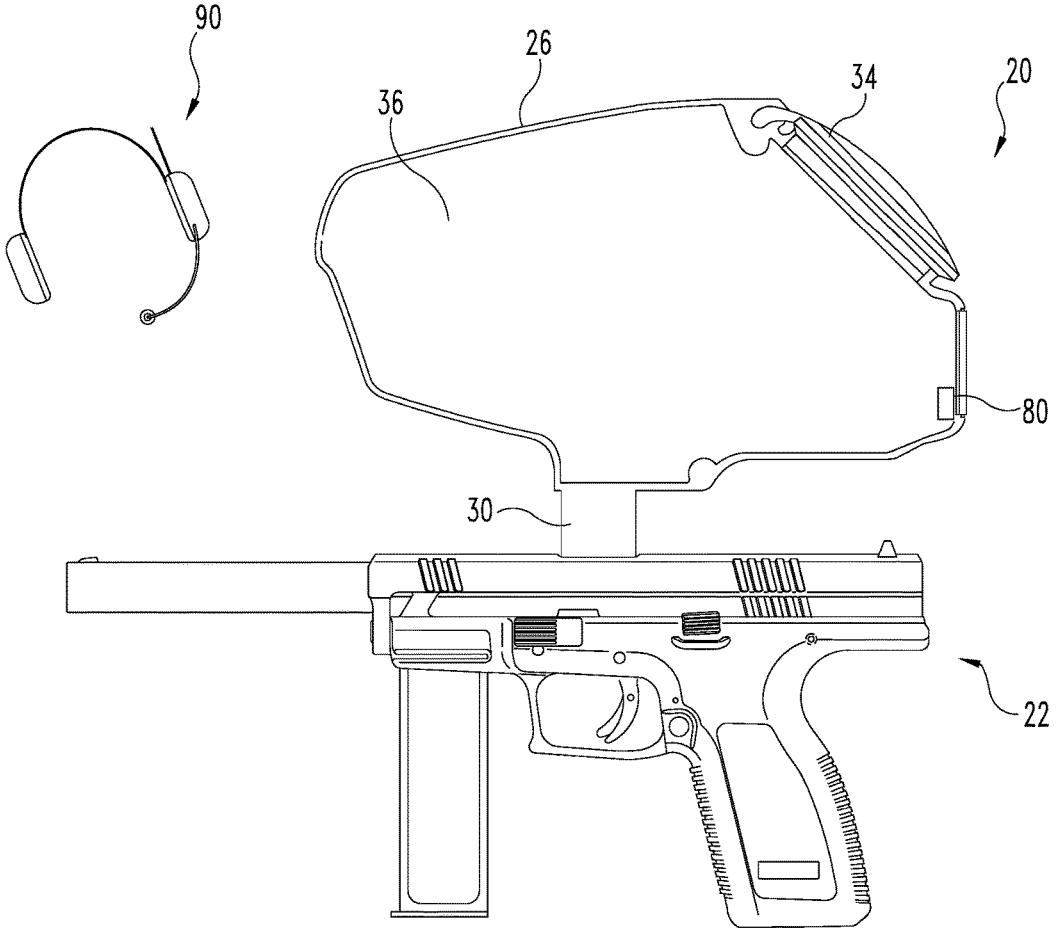
FIG. 1 is a side elevational view of an embodiment of a paintball loader connected to an embodiment of a paintball marker or gun.
Figure 2:
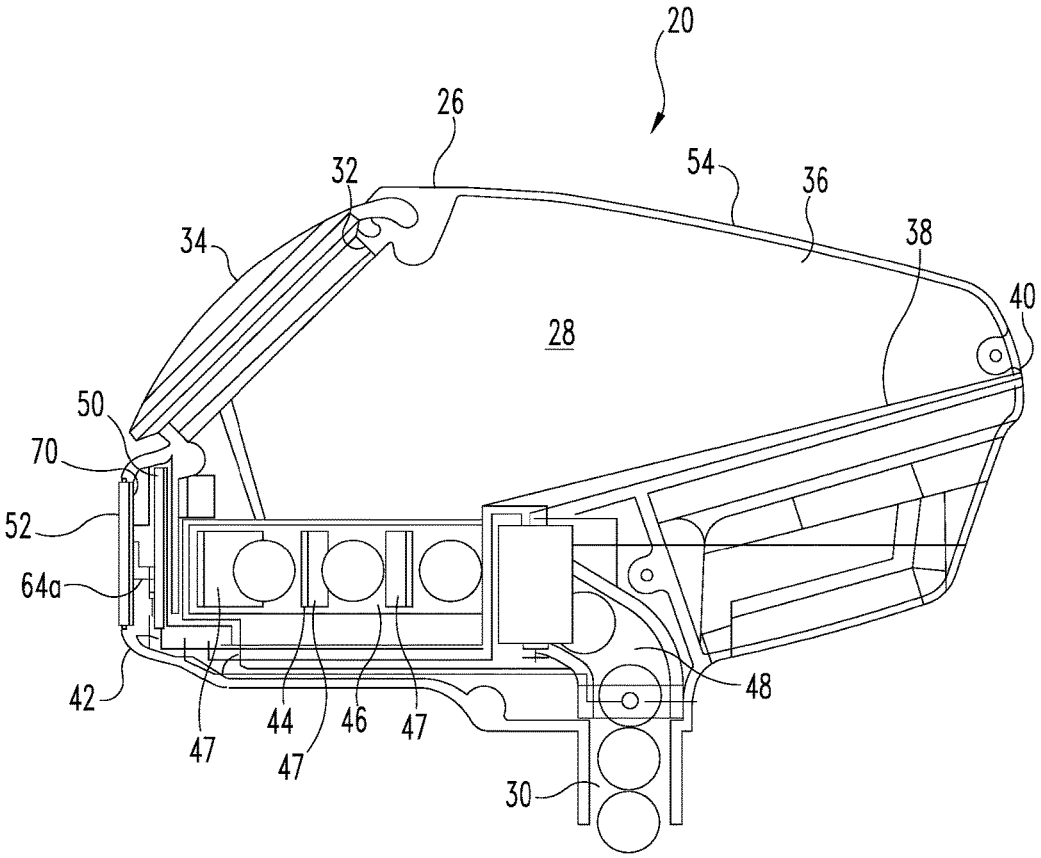
FIG. 2 is a side sectional view of the embodiment of a paintball loader shown in FIG. 1.

Referring now generally to FIGS. 1 and 2, there is shown an embodiment of a paintball loader 20. Loader 20 is designed for insertion into a paintball marker 22 so as to feed paintballs stored in loader 20 into marker 22 for firing. Generally, a steady stream of paintballs is supplied to marker 22 so that when one paintball is fired from marker 22, another paintball is immediately available for subsequent firing. Loader 20 holds a relatively large supply of paintballs, and may actively or passively continue the supply to marker 22. While the term "paintball" is used herein to indicate the general nature of the equipment and usage, it will be understood that similar pneumatic, electric and/or mechanical projectile launching equipment, e.g. those used in airsoft games, can be a focus of the present subject matter.

The illustrated embodiment of loader 20 includes a shell 26 defining an internal chamber 28 and an outlet 30 connected to chamber 28. An external opening 32 is provided in shell 26, which may be closed or covered by a cap 34. Cap 34 may be attached to shell 26 by a hinge that allows cap 34 to be pivoted onto or away from opening 32, it may be threaded onto a flange of shell 26 that surrounds opening 32, or it may be placed or fitted on shell 32 in a number of other ways. Chamber 28 is defined by side walls 36 of shell 26, and also by an internal floor 38 that slopes generally downward, so that paintballs within chamber 28 tend to flow or move toward a low point in floor 38. In the illustrated embodiment, floor 38 slopes generally downward from the front 40 (or a point near the front) toward the rear 42 of loader 20. Outlet 30 is generally cylindrical in this embodiment, and is sized to be inserted into marker 22 in known fashion so that paintballs can move from loader 20 into marker 22 for firing. It will be understood that the general principles for loading an airsoft guns are essentially the same, airsoft guns are loaded from clips under the under the gun.

This embodiment of loader 20 also includes an electric feeding mechanism 44 with a pan 46 at or around the lowest point of floor 38, a series of blades 47 and an exit conduit 48. Blades 47 are rotatably mounted in pan 46, and conduit 48 generally extends from a side of pan 46 and turns down toward or into at least a part of outlet 30 of shell 26. Electrical conductors (not shown) provide an electrical signal to mechanism 44, which causes blades 46 rotate to move one or more paintballs toward and into conduit 48, thus actively maintaining supply to marker 22.

Loader 20 further includes a circuit board 50, a display 52, and an antenna 54 in the illustrated embodiment. Circuit board 50 may be positioned in a variety of places in loader 20, because of the relatively large amount of space loader 20 occupies. In a preferred embodiment, circuit board 50 is placed in a cavity in the rear 42 of loader 20 so that board 50 is substantially vertical when loader 20 is connected to marker 22 and marker 22 is pointed substantially horizontally. While board 50 may be placed in a number of other locations in loader 20, it has been found that a rear cavity as in the illustrated embodiment provides the best combination of protection for, accessibility to, and ease of electronic connection to board 50. Embodiments in which board 50 is placed under floor 38 of shell 26 are possible. Such embodiments provide excellent protection for board 50, but present a greater challenge to accessing board 50, particularly with mechanism 44 being adjacent.

Embodiments in which board 50 is placed in the front or top of shell 26 are also contemplated, although such placement would make loader 20 bigger or thicker (to accommodate board 50 while maintaining the inner dimension of chamber 28) in a part of loader 20 that should be kept as small or slim as possible, both to present a smaller target to the opponent and to allow the user a wider field of sight around it. Further, the front, sides and top of loader 20 are regularly exposed to fire from opponents, and so positioning board 50 along those exterior portions risks some damage from opponents' paintball strikes. Board 50 can also be placed more deeply within loader 20, but doing so tends to limit the space available for paintball storage or to require enlargement of the overall loader so that the paintballs or other parts of the loader do not impact board 50 or access to or ventilation of it.

Figure 3:
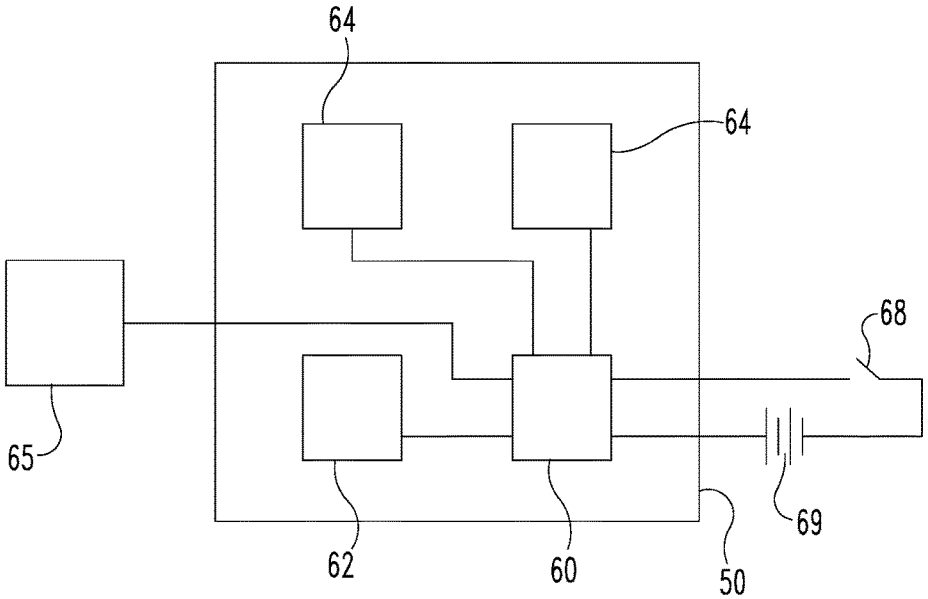
FIG. 3 is a schematic representation of electronic components used in the embodiment of a paintball loader shown in FIG. 1.

Circuit board 50, in one embodiment, includes a microcontroller 60 and is connected to each of a transceiver 62, one or more outputs 64, and one or more inputs 65, as indicated schematically in FIG. 3. Imprinted conductors are used to electronically connect these features. Microcontroller 60 is a hardware device with software or firmware and is capable of processing a variety of electronic signals. In a particular embodiment, microcontroller 60 includes or has associated with it sufficient memory to function as a data server, so that data can be passed from microcontroller 60 to marker 22, other paintball equipment, and/or other devices such as external computers. In a particular embodiment, microcontroller 60 is a PIC or ARM7 processor with USB native support, and at least 512 KB of memory is provided with microcontroller 60. Microcontroller 60 may include security software or firmware, so that keycodes, special frequencies or other measures can be used to ensure that information from one team member's loader is only passed to his or her teammates' loaders, or so that only the owner of the loader can access the memory in its microcontroller.

In certain embodiments, transceiver 62 is a part of or hard-wired into circuit board 50. It is also contemplated that transceiver 62 could be provided as separate transmitting and receiving components, each of which are a part of board 50 or otherwise electronically connected to microcontroller 60. Transceiver 62 is electronically connected to microcontroller 60 so that signals received by transceiver 62 can be electronically passed to microcontroller 60, and so that microcontroller 60 can send signals to transceiver 62 to be transmitted, as is further discussed below. In a particular embodiment, transceiver 62 operates at 2.4 GHz to effectively provide for wireless transmissions or Ethernet communications, to other loaders, to external computers or other devices, or to the particular marker with which a particular loader is physically connected. A separate transceiver operating at a different bandwidth (e.g. 915 MHz) may be provided for communicating with particular markers or other particular devices.

Outputs 64 electronically connect microcontroller 60 to display 52 and antenna 54, and perhaps other components. Outputs 64 are plug-in ports that are hard-wired on circuit board 50 in this embodiment, and can also include cables or other conductors extending from circuit board 50. For example, a wire (not shown) electronically connects circuit board 50 to antenna 54, and a bus or cable 64*a* is plugged into an output port 64 to connect circuit board 50 (and microcontroller 60) to display 52. Information from microcontroller 60, which may be inputted from transceiver 62, inputs 65 or other sources, and may be raw information from those sources or data that has been operated on by microcontroller 60, is passed via output 64 to display 52. As is further discussed below, display 52 receives such information and displays at least a portion of it to the user.

Inputs 65, in one embodiment, are one or more external buttons, pads (e.g. keypads), touch-screens, or similar tactile inputs through which the user can manually enter data or instructions. For example, in a particular embodiment external inputs 65 are touch-screen fields located on a particular screen or view on display 52. Buttons or pads may be used as well as or in place of such touch-screen fields, and may be located preferably toward or at a rear portion of loader 20 (or physically associated with display 52, e.g. on its perimeter) to afford protection from opponents' paintball shots. Such positioning also makes inputs 65 immediately accessible to the loader's user without having to turn marker 22 or loader 20. The user can keep pointing marker 22 in front of him or her while inputting information via inputs 65.

In the illustrated embodiment, a switch 68 and one or more batteries 69 are provided to power microcontroller 60, display 52, and transceiver 62, and perhaps other parts of loader 20. It will be seen that separate power sources (and associated switches) could be provided for each separate part, but it has been found that adequate power can be provided, in an efficient way, by connecting a single battery or group of batteries to microcontroller 60, display 52 and transceiver 62. In a particular embodiment the battery or batteries may be rechargeable, and a plug-in recharging port may be provided on loader 20 and connected to the battery(s). In addition, embodiments of loader 20 and/or marker 22 may have one or more sensors dedicated to monitoring performance or conditions of those items. For example, sensors for number of paintballs used or remaining, firing or dwell time, temperature, battery life and/or malfunction of one or more mechanisms may be included in appropriate locations in loader 20 and/or marker 22. Such sensors will be communicatively connected to microcontroller 60 via printed circuit paths, wires, wireless connections, or other ways, and microcontroller 60 can send such data to display 52 for display to the user. Similarly, information such as the mode of firing (e.g. semi-automatic or automatic) of marker 22 or spring tension in loader 20 can be sent to microcontroller 60 and on to display 52.

Display 52 is a "heads-up display" in the illustrated embodiment, meaning that it is positioned on loader 20 so that the user has the display upright and viewable when he or she is using loader 20 (and marker 22). Display 52 is attached to the rear of loader 20, and in one embodiment is directly over part or all of circuit board 50. As seen in FIG. 2, board 50 is within shell 26 of loader 20 at the rear of loader 20, and a barrier or separating flange 70 separates board 50 from display 52. Display 52 is fitted in a countersunk opening in shell 26, so that the outer surface of display 52 is approximately flush with or slightly recessed in shell 26. In embodiments in which board 50 includes plug-in input and/or output ports, display 52 may include a hard-wired port or cable connection (e.g. cable 64*a*) that can be directly plugged into a port on board 50. The close proximity of display 52 to board 50 leaves less possibility for interruption or interference to signals sent from microcontroller 60 to display 52, and allows easy access to both parts at once. Display 52 is an OLED device in a particular embodiment, capable of displaying text and images, and as noted previously may have touch-screen capability as well. In other embodiments, display 52 may be an LCD display.

Antenna 54 is a long-range antenna in the illustrated embodiment, coated in rubber. In the illustrated embodiment, antenna 54 extends along an outer surface of shell 26, such as an upper surface opposite outlet 30. In other embodiments, antenna 54 may be located inside shell 26, for example on an inside surface of shell 26 facing chamber 28, or in a space formed between the outside of shell 26 and a surface facing chamber 28. As seen in FIG. 2, antenna 54 can be situated near the top of loader 20. This position has been found to provide clearer reception and transmission over other positions, because there is less matter through which signals must pass to get to or from antenna 54 and because the electronics of circuit board 50 and the circuit of mechanism 44 are relatively distant from antenna 54. Antenna 54 is electronically connected to transceiver 62 in this embodiment. Thus, signals sent from transceiver 62 pass to antenna 54 and are then broadcast, and signals from other sources can be picked up by antenna 54 and are sent to transceiver 62 (and microcontroller 60) for processing.

In certain embodiments, an external port 80 (e.g. a USB port) can be provided in loader 20 for uploading or downloading information to or from loader 20. Such a port may be placed in any number of locations on loader 20, although for protection and convenience such a port is preferably located near or adjacent to circuit board 50. Port 80 is electronically connected to microcontroller 60 (e.g. via conductors imprinted on circuit board 50) so that information from an external source (e.g. a flash drive) can be inputted into microcontroller 60, or information from microcontroller 60 can be downloaded to an external source. As noted above, microcontroller 60 may have USB native support.

Microcontroller 60 and or transceiver 62 is also linked in this embodiment with a wireless headset 90. Headset 90 is worn by the user of loader 20 and marker 22 so that the user can speak to and hear from teammates. Thus, verbal communications can be sent from the user's headset 90 to other team members (or received from other team members and sent to the user's headset) via transceiver 62, antenna 54 and/or circuit board 50.

In use, loader 20 is physically connected to marker 22 by inserting outlet 30 into a conduit in marker 22. Chamber 28 of loader 20 is filled with paintballs (not shown), by pouring them into chamber 28 through opening 32. Circuit board 50 of loader 20 is powered up, as are the sensors and circuits in marker 22, as by operating one or more switches to allow battery power to those items.

As further preparation for use, each user's loader 20 is synched with a base or "command" computer, and those users synched with a particular base computer may be thought of as a "communication group." In the simplest form, on powering up microcontroller 60 sends a signal via transceiver 62 and antenna 54 to the command computer, asking for a synchronized link-up. Such a signal may be an automatic step, performed in response to software or firmware, or may be a step manually requested by the user, via responses keyed in or otherwise inputted through inputs 65. As a part of the synching process with the command computer, the computer assigns a unique wireless identification to each user's loader 20, which identification is stored in microcontroller 60. Several different communication groups can be created at the time of synching loaders with the command computer, and each user can thereafter select one or more groups to communicate with via his or her own loader 20.

The users can then synch respective wireless headsets 90 to respective loaders 20. Once again, such synching can be an automatic step on powering up headsets 90, or can be the result of keyed or otherwise inputted instructions to microcontroller 60. The synchronization of the headsets with their respective loaders creates an additional unique identification between the particular loader/headset pair so that the voice communication of one user will not interfere with the communications of others.

A user may transmit audio or data to others first by selecting a set of users or a communication group. The user inputs the players or group to be contacted via inputs 65 (e.g. keying in the information on a keypad or via buttons, or by touching the appropriate group(s) or portion(s) on a touch-screen of display 52). That choice is sent to microcontroller 60. A packet of information including the content of the message (data or voice information) and the identifying information of the selected users or communication group is broadcasted via transceiver 62 and antenna 54. Any loader 20 within range receives that broadcast. The packet is sent to the receiving loader's microcontroller 60. If that receiving loader's unique identification matches the identifying information of the selected users in the received packet (i.e., if the receiving loader is that of one of the users for whom the message was intended), then microcontroller 60 sends the message on. Data messages are sent to display 52, so that the receiving user is able to view the message. Voice messages are sent to the user's wireless headset 90, which is synched to the user's loader 20. The receiving loader provides the user with the option of deleting the data message (if any), and of replying to the message.

Inputs 65 can also be used to change settings of loader 20 and/or marker 22, such as firing mode or profile, rate of firing or feeding, broadcast frequency or other features, and the like. The user inputs the instructions via keypad, buttons, touch-screen or other inputs, and those instructions feed into microcontroller 60. Microcontroller 60 then sends a packet of information to the appropriate place (a feature in or on loader 20 and/or marker 22) via wired or wireless transmission. In on example, if the instructions are for a part of the loader 20, then wired transmission may be preferred, whereas transmission of a message to marker 22 may preferably use wireless transmission (via transceiver 62, for example). Wired communication between marker 22 and loader 20 is possible if a wire or cable (e.g. a USB cable) is connected between them. The transmission from loader 20 is received by circuitry in marker 22, and the settings of marker 22 are changed by the circuitry in accordance with the instructions. Wired or wireless links between marker 22 and loader 20 are bidirectional in this embodiment, so that loader 20 can transmit instructions to marker 22 and also receive information from its circuitry concerning its performance.

It will also be seen that data stored in microcontroller 60 can be later downloaded to a computer or other external data analysis or storage device. For example, following the end of a paintball game or exercise, a wireless link or wired link (e.g. via USB cable or other conductors connected to ports on the outside of loader 20 or circuit board 50) can be made with a personal or other computer. Data can then be downloaded to the computer and analyzed for quality of performance, quantity of ammunition expended, error reports from sensors or from the microcontroller, types or substance of communications, or other factors. Additional software and/or data may be uploaded to the microcontroller via the same or similar connections, to provide additional abilities or analytical modes to the microcontroller.

Thus, it has been found that a paintball loader is an ideal area to display marker (gun), loader, and other game statistical and tactical information, as the loader has large empty spaces on the shell and the loader is commonly held directly in front of the user's face. Since the loader is elevated above the marker, it is more visible to the user during use and offers less blockage (physically or electronically) to antennas or other communication equipment. A larger, more informative and more useful display can be used. The present disclosure allows for the consolidation of paintball equipment information into a single location. The display on the loader can show information from the paintball marker such as current firing mode, rates of fire, battery life, and other data. The display would also relay loader information to the user such as feed rates, torque setting, speed setting, spring tension, battery life, sensor mode, sensor activity or other operating data.

The present disclosure would allow a display area for tactical information such as team-mate position, opponent position, current game score, and/or other factors. The devices disclosed may communicate with each other by wired or wireless means. Thus, three types of data or output can be shown by a display: information from or related to the gun or marker, information from or related to the loader, and/or information from external sources.

The loader's electronics may serve as a data server for other paintball equipment. It has been found that because of the loader's large area and natural unobstructed exposure to a player's environment, the loader is an ideal data server or data relay center. The electronics would not only receive data from other equipment, but could also broadcast data or setting information to other equipment. For instance, the player could change his paintball marker settings by entering the new values on his or her loader. The player could also broadcast current tactical information to teammates by entering the data into the loader and having the loader relay such information.

Figure 4:
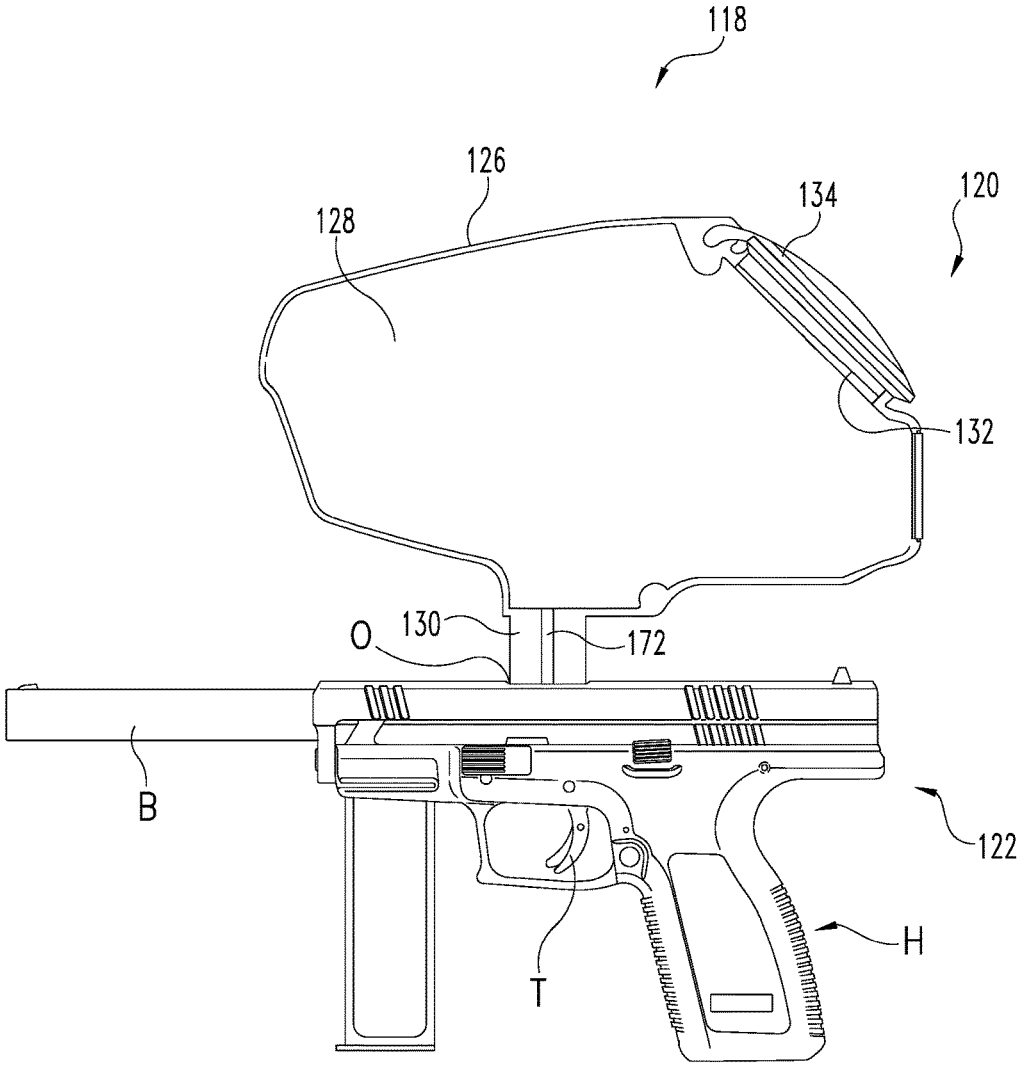
FIG. 4 is a side elevational view of an embodiment of a paintball loader connected to an embodiment of a paintball marker or gun.
Figure 5:
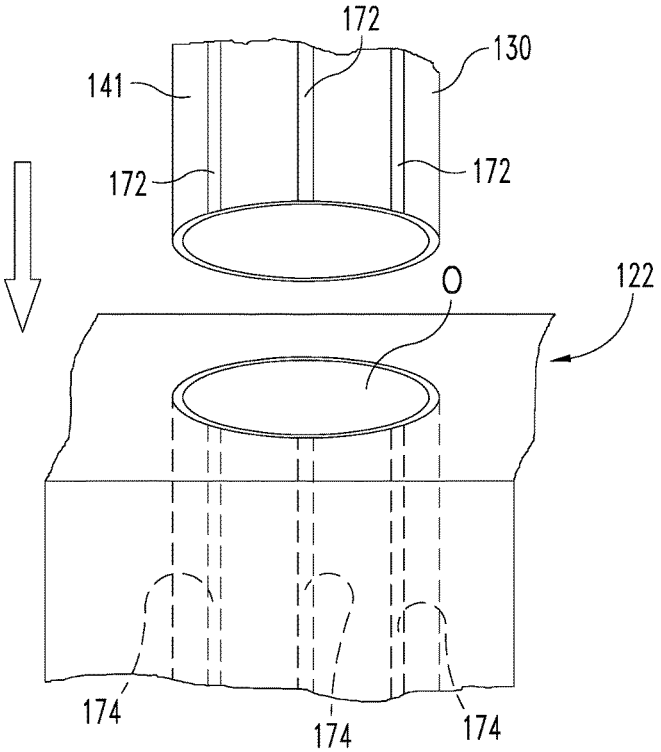
FIG. 5 is a perspective view of a portion of the embodiment shown in FIG. 4.
Figure 6:
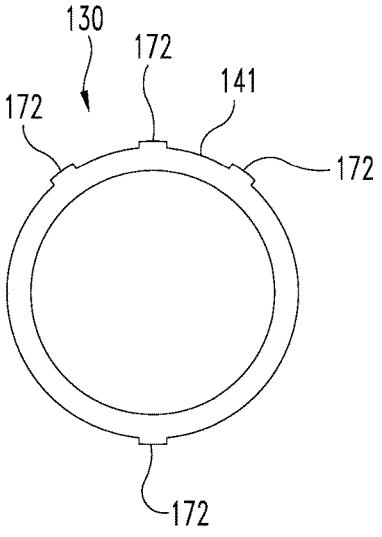
FIG. 6 is an end plan view of a portion of the embodiment shown in FIG. 5.
Figure 7:
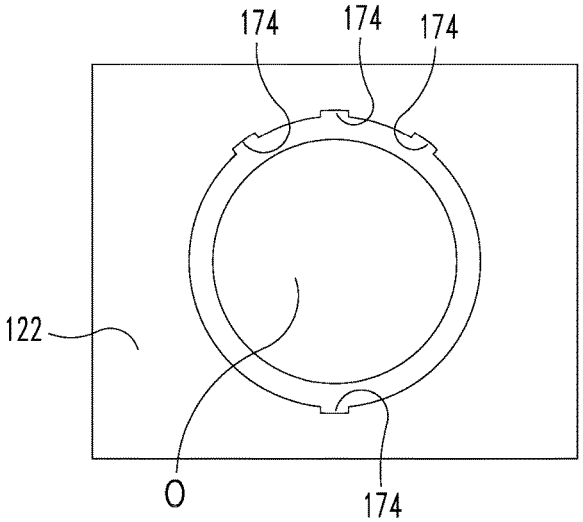
FIG. 7 is a top plan view of a portion of the embodiment shown in FIG. 5.
Figure 8:
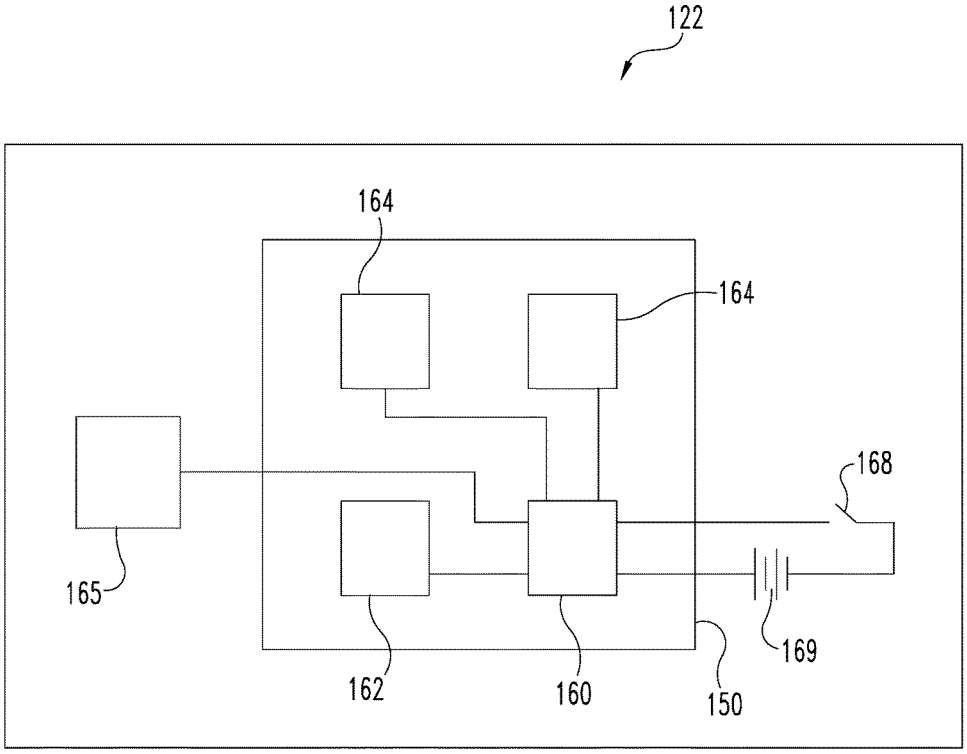
FIG. 8 is a schematic representation of an embodiment of electronic components used in the embodiment shown in FIG. 4.

Referring now generally to FIGS. 4-6, there is shown an embodiment of a paintball marker system 118 including a loader 120 and a marker or gun 122. Generally, unless otherwise indicated apparatus or features that are similar or identical to those described above are numbered with the same number with the initial number 1. Loader 120 is designed for insertion into marker 122 so as to feed paintballs stored in loader 120 into marker 122 for firing. Generally, a steady stream of paintballs is supplied from loader 120 to marker 122, automatically or on a request from electronics associated with marker 122, so that when paintball(s) are fired from marker 122, another or additional paintball(s) are immediately available to marker 122 for subsequent firing. Loader 120 holds a relatively large supply of paintballs, and may actively or passively continue the supply to marker 122.

The illustrated embodiment of marker 122 represents any of a number of available markers, which generally have a stock or handle H, a trigger T, and a barrel B. An opening or feedneck O is provided in marker for insertion of a part of loader 120. Paintballs are supplied by loader 120 to a firing chamber or area within marker 122, and pressing trigger T causes one or more paintballs to be ejected from barrel B, as by application of compressed gas.

The illustrated embodiment of loader 120 generally represents any of a number of available types of loaders, which generally include a shell 126 defining an internal chamber 128 and an outlet or chute 130 connected to chamber 128. An external opening 132 is provided in shell 126, which may be closed or covered by a cap 134. Loader 120 may be structurally identical to loader 20 described above, or with differences in electronic components as outlined below. Outlet 130 is generally cylindrical in this embodiment, having an outer surface 141, and is sized to be inserted into opening O of marker 122 so that paintballs can move from loader 120 into marker 122 for firing.

As indicated above, embodiments of loader 120 and marker 122 include one or more electronic parts for proper or efficient operation. For example, marker 122 can include a number of electronic parts for monitoring or affecting performance, such as a circuit board 150 with microcontroller 160, transceiver 162 and/or outputs/inputs 164, 165 may be provided on or in marker 122. In some embodiments, inputs from the user as to desired firing rate or other performance parameters are electronically conveyed to the microcontroller 160 via inputs 165, as are inputs from sensors in marker 122, e.g. sensing a trigger actuation or sensing efficiency or physical conditions within marker 122 or its firing mechanisms. Circuit board 150 and/or microcontroller 160 process these inputs and regulate firing of marker 122, as by electronic output signals from outputs 164 sent to fire one or more paintballs, individually or in a burst. A battery or other power source 169 (and perhaps a switch 168) is provided on or in marker 122 to provide energy to the electronic parts of marker 122.

Similarly, in this embodiment loader 120 has one or more electronic components, such as an electronic paintball feeding mechanism, sensors (e.g. for noting capacity and/or quantity of paintballs available, feed speed, or other characteristics of loader 120 or its operation), displays, inputs, or the like. For example, loader 120 may have an electronic feeding mechanism as described above. However, in this embodiment loader 120 does not include a microcontroller or circuit board for controlling, providing input to or accepting output from such electronic components. Further, the illustrated embodiment of loader 120 does not include a battery or other power source to power such components. As discussed further below, power and/or other electronic signals are transferred to loader 120 from marker 122 in the illustrated embodiment.

Loader 120 and marker 122 and each include a plurality of contacts for mutual engagement and electrical connectivity. In the illustrated embodiment, loader 120 includes one or more contacts 172 for connection to marker 122, as will be discussed further below. The term "contacts" as used herein is intended to indicate any of a variety of structures for electrically connecting two pieces. In the illustrated embodiment, contacts 172 are exposed metal leads on the outer surface 141 of the paintball chute 130 of loader 120. Leads may be set into or along chute 130 of loader 120, or may be spring-loaded to ensure a firm electrical connection. As another example, contacts 172 may be a plurality of male (prongs), female (sockets) or a mixture with metal surfaces, for accepting corresponding female or male items with metal surfaces so that the surfaces of pairs of corresponding contacts join to enable an electrical connection between them.

Marker 122 likewise includes a set of one or more contacts 174, and preferably one contact 174 for each contact 172 of loader 120. In particular embodiments, contacts 174 are structures as described above with respect to contacts 172. Each contact 174 is compatible with a contact 172, i.e. able to mate with a contact 172 with respective metal portions engaged. For example, if a particular contact 172 is an exposed metal lead, its respective compatible contact 174 may also be an exposed metal lead. As another example, if a particular contact 172 is a metal prong, its respective compatible contact 174 may be a socket with internal metal surface(s) for contacting the prong when connected.

Respective contacts 172, 174 form respective pairs, and when connected, each such pair of contacts 172, 174 connect one or more electronic pathways. Each such pathway or pair of contacts 172, 174 may have a particular use (e.g. connecting a sensor in loader 120 to controller 160 in marker 122, connecting controller 160 in marker 122 to a feeding mechanism in loader 120, or connecting power source 169 in marker 122 to loader 120). It will be understood that each desired connection between parts of loader 120 and marker 122 may have a separate pathway and pair of contacts, or one or more such pathways (in conjunction with switches or other electronic controls) may handle one or more sets of signal traffic.

Contacts 172, 174 are electronically linked to electronic components of their respective devices, as by wires, cables, buses, printed circuits or connectors, or similar structure for transferring electronic signals. Accordingly, when loader 120 is inserted into marker 122, so that chute 130 enters opening 0, contacts 172 and 174 engage each other. The engaged contacts 172, 174 complete pathways between loader 120 and marker 122, so that electronic signals can be passed between them. As indicated above, it will be understood that the pathways enable electronic connection of components in loader 120 and marker 122. As one example, an output 164 of controller 160 in marker 122 is electronically connected to a particular contact 174, and the corresponding contact 172 on loader 120 is electronically connected to a feeding mechanism of loader 120. When controller 160 determines that feeding of paintballs should occur (as after pressing trigger T or similar input), a signal may be sent from the particular output 164 via the particular engaged contacts 174 and 172 to the feeding mechanism, and the mechanism operates to feed one or more paintballs. In similar fashion, connections are created and maintained via pairs of contacts 172, 174 to ensure transfer of power, sensor signals, data, instructions or other electronic signals along particular hardwired pathways.

The example given above places circuit board 150, controller 160 and battery 169 in or with marker 122. It will be understood that any or all of these features may be placed instead in loader 120—e.g. systems in which loader 120 includes a power source and control electronics and sends signals to marker 122 are contemplated. Engagement of contacts 172, 174 and the creation of electronic pathways thereby allows secure sending of electronic signals in either direction, from or to marker 122 or loader 120. As indicated above, the advantage of operating electronic components in both devices with a single controller and other electronic pieces has substantial cost and simplicity of operation and maintenance advantages.

In particular embodiments, the engagement of contacts 172, 174 occurs automatically on insertion of a portion of loader 120 into marker 122. No separate action, such as separate adjustment or plugging-in of contacts apart from manipulation of loader 120 and/or marker 122, is needed to create the electrical connection. For example, chute 130 or another portion of loader 120 may have an interference or snap fit into opening 0 or another portion of marker 122. That tight or snap fit can ensure secure engagement of contacts 172, 174. If contacts 172, 174 are prong-and-socket contacts, they can provide or assist the engagement between loader 120 and marker 122. It will be understood that other types of connections, such as a bayonet-type connection in which contacts 172, 174 are engaged with each other upon completion of the connection, can be used.

In general terms, embodiments of equipment and systems as described herein can feature a consolidation of processor, memory, and battery components between a gun and loader, such that the gun and loader are unable to fully function without being connected to the other. As an example, one or more microcontrollers in one component are used to coordinate and/or operate active functions in both components (e.g. firing function(s) or operation(s) in the marker, and loading function(s) or operation(s) in the loader). As another example, one or more batteries in one component provide energy for operation of active functions in both components (e.g. firing function(s) or operation(s) in the marker, and loading function(s) or operation(s) in the loader). While circuit boards can contain integrated, small "supplemental batteries" to keep settings or dates/times in memory (e.g. a CMOS battery on a computer motherboard), such supplemental batteries do not have sufficient power to operate such active functions of either a marker or loader. For example, a gun may have a small supplemental battery used to retain settings or keep time, but it is unable to activate the marker's solenoid (and thus fire a paintball)—power for firing must come from another source, proposed above as being from a loader. Similarly, while there may exist simple circuit(s) (e.g. a integrated circuit or microprocessor) in a loader, the loader can rely on a processor or controller in the gun (or vice versa) for its active operation. Thus, embodiments are disclosed herein of a marker/loader system in which the loader is unable to load paintballs without receiving battery or computing power from the gun, and/or the gun is unable to fire paintballs without receiving battery power or computing power from the loader.

As used herein, the term "electrical signal" or "electronic signal" or similar terms indicate passage of a current for purposes of operating an electrical or electronic device (e.g. conducting power for operation), for purposes of transmitting a message or other data, or for other purposes. Further, as noted above, the term "paintball" indicates equipment and projectiles for use in the sport of paintball and similar sports, such as airsoft.

While the subject matter herein has been illustrated and described in detail in the exemplary drawings and foregoing description, the same is to be considered as illustrative and not restrictive in character, it being understood that only the preferred embodiment(s) have been shown and described and that all changes and modifications that come within the spirit of the disclosure are desired to be protected. It will be understood that structures, methods or other features described particularly with one embodiment can be similarly used or incorporated in or with respect to other embodiments.

For example, it is contemplated that the loader as described herein could communicate with a variety of paintball equipment, such as masks, barrels, gloves, tanks, regulators, pods, or scoreboards, and also with computers, watches, PDAs, mobile or other telephone systems, printers or intercom systems. In addition, all publications cited herein are indicative of the abilities of those of ordinary skill in the art and are hereby incorporated by reference in their entirety as if individually incorporated by reference and fully set forth.

What is claimed is:

1. A method of operating paintball equipment, comprising:

providing at least one paintball loader having circuitry including a microcontroller and providing at least one associated paintball marker having circuitry, each said loader being a device initially separate from and insertable into and removable from to a respective one of said markers;

establishing a wireless link between said microcontroller and a separate computer, and synching said microcontroller with the computer so that each of said microcontrollers are identified as a communication group and each of said microcontrollers is assigned an identification code over said wireless link;

broadcasting a message from one of said loaders, said message including information identifying said one of said loaders or at least one loader in the communication group;

receiving said message by at least one of said loaders or said separate computer; and sending said message to a visual or auditory output.

2. The method of claim 1, further comprising providing at least one headset having at least one speaker and a microphone, each of said headsets being associated with a respective loader, and wherein said broadcasting includes speaking said message into a microphone of one of said headsets, said message being transmitted from said one of said headsets to its associated loader.

3. The method of claim 1, further comprising providing at least one headset having at least one speaker and a microphone, each of said headsets being associated with a respective loader, and wherein a speaker of the headset associated with the at least one loader involved in the receiving functions as said auditory output.

4. The method of claim 1, further comprising establishing a wireless link between one of said loaders and a respective marker, transmitting a signal concerning data of said respective marker from said respective marker to said one of said loaders, and displaying said data on a display on said loader.

5. The method of claim 4, wherein said link is bidirectional, so that instructions may be transmitted from said one of said loaders to said respective marker.

6. The method of claim 1, further comprising storing said message in said microcontroller for access following said sending.

7. The method of claim 1, further comprising inputting information of a set of players via one or more electronic inputs in said loader, wherein said loader broadcasts said information to at least one other loader of said set of players.

8. The method of claim 1, further comprising storing data developed from operation of at least one of said markers in a microcontroller of at least one of said loaders, and following said storing, downloading said data to an external data analysis or storage device.

9. A method of operating paintball equipment, comprising:

sending a message from at least one loader to a predetermined communication group including a separate computer, the at least one loader having a microcontroller fixed to it adapted to control the sending, the predetermined communication group created by synching the at least one loader to the separate computer prior to the sending;

receiving the message by the communication group.

10. The method of claim 9, wherein the at least one loader includes a transceiver fixed to the loader and operatively connected to the microcontroller, and the transceiver performs the sending.

11. A method of operating paintball equipment, comprising:

establishing a wireless link between each of a group of at least one paintball loader and a separate computer, each of said paintball loaders having circuitry including a microcontroller, each of said paintball loaders being a device initially separate from and insertable into and removable from a respective paintball marker, said establishing including establishing a wireless link between each said microcontroller and said separate computer, and synching each of said microcontrollers with the computer so that each of said microcontrollers are identified as a communication group, and each of said microcontrollers is assigned an identification code over said wireless link;

broadcasting a message from one of said paintball loaders, said message including information identifying said one of said loaders or at least one loader in the communication group;

receiving said message by said separate computer or at least one of said loaders, and outputting said message.

12. The method of claim 11, further comprising the step of synching a wireless headset to each of said paintball loaders.

13. The method of claim 11, wherein the message is one of an audio message and a data message.

14. The method of claim 11, wherein the establishing includes sending a signal from the respective microcontroller of each of said paintball loaders to said separate computer.

15. The method of claim 11, further comprising the step of selecting a set of users to whom to transmit at least one of audio and data from the microcontroller of at least one paintball loader of said group.

16. The method of claim 11, wherein the receiving is by at least one of said loaders and said message is sent to the microcontroller of said at least one receiving loader, and sending said message to a visual or auditory output associated with said receiving loader.

* * * * *